US011607105B2

(12) United States Patent
Rotteveel et al.

(10) Patent No.: US 11,607,105 B2
(45) Date of Patent: Mar. 21, 2023

(54) SHOE CLEANING DEVICE

(71) Applicant: Evert Rotteveel, Londonderry, NH (US)

(72) Inventors: Evert Rotteveel, Londonderry, NH (US); Jorge Escobedo, Roslindale, MA (US)

( * ) Notice: Subject to any disclaimer, the term of this patent is extended or adjusted under 35 U.S.C. 154(b) by 6 days.

(21) Appl. No.: 17/050,411

(22) PCT Filed: Apr. 24, 2019

(86) PCT No.: PCT/US2019/028866
§ 371 (c)(1),
(2) Date: Oct. 23, 2020

(87) PCT Pub. No.: WO2019/209917
PCT Pub. Date: Oct. 31, 2019

(65) Prior Publication Data

US 2021/0059502 A1 Mar. 4, 2021

Related U.S. Application Data

(60) Provisional application No. 62/661,731, filed on Apr. 24, 2018.

(51) Int. Cl.
*A47L 23/22* (2006.01)
*A47L 23/02* (2006.01)

(52) U.S. Cl.
CPC ..... *A47L 23/22* (2013.01); *A47L 23/02* (2013.01)

(58) Field of Classification Search
None
See application file for complete search history.

(56) References Cited

U.S. PATENT DOCUMENTS 5,031,258 A * 7/1991 Shaw ..... E03C 1/057 4/304
2009/0098031 A1* 4/2009 Crist ..... A47L 23/02 422/292
2017/0128606 A1* 5/2017 Jackson ..... A47L 23/266

* cited by examiner

*Primary Examiner* — Natasha N Campbell
*Assistant Examiner* — Pradhuman Pari Parihar
(74) *Attorney, Agent, or Firm* — Tredecim LLC; Sean L. Sweeney

(57) ABSTRACT

Disclosed herein are novel shoe cleaning devices for cleaning the soles of shoes. The shoe cleaning devices include a base including a pump bay and a pump located within the pump bay; a top body disposed above and secured to the base, the top body including one or more connection port recesses and a fluid cartridge aperture; a cover, the cover including a wet area aperture, a fluid port array disposed around the wet area aperture, a dry area aperture, and one or more connection ports configured to mate with the one or more connection port recesses; and a fluid cartridge in fluid communication with the pump and the fluid port array such that operation of the pump causes fluid to flow from the fluid cartridge, through the connection ports and out the fluid port array.

17 Claims, 5 Drawing Sheets

SHOE CLEANING DEVICE

CROSS-REFERENCE TO RELATED APPLICATIONS

This application claims the benefit of U.S. Provisional Patent Application No. 62/661,731, filed Apr. 24, 2018, the disclosure of which is herein incorporated by reference.

BACKGROUND

1. Field of the Invention

The present invention pertains to the field of shoe cleaning devices. Specifically, this invention relates to a novel shoe cleaning device and method that allows users to efficiently and effectively clean and disinfect the soles of their shoes.

2. Discussion of Background Information

The problem of effectively cleaning shoe soles is well known. A dirty shoe not only tracks visible dirt and debris into homes and businesses, but also carries invisible external contaminants, exposing people to harmful bacteria and other pathogens.

Current culture places a premium on a safe and healthy home, driving demand for a host of wet wipes and advanced cleaning products targeted for nearly every surface in the house. However, almost no conscious thought is directed to the fact that dirt and dangerous bacteria from the street are routinely introduced into the home via our shoes. Shoes, and specifically shoe soles, are one of the single dirtiest surfaces that we come into contact with in our day-to-day lives, providing a gateway for tens of millions of organisms to enter our homes. Unfortunately, traditional doormats are unable to stem this tide and the general cleaning products used by most homeowners are ineffective at addressing the source of the problem.

Door mats are the traditional device used to reduce the dirt and debris tracked into a home or business. While designs vary widely, door mats are usually designed to employ mechanical cleaning, such as scraping or brushing, in order to remove material from the sole of a shoe. Traditionally, door mats are made out of a durable material that can withstand this repetitive mechanical action and door mats designed for an industrial setting may include additional brushing or scraping features to aid in the cleaning process. Despite the prevalence of door mats, these devices fail to adequately protect our homes and businesses. Not only do they require regular cleaning and replacement in order to remain effective, but they universally fail at removing invisible contaminants and pathogens.

In order to make up for the inherent shortcomings of traditional door mats, a person may remove their shoes, or even change shoes, in order to avoid tracking invisible contaminants and pathogens inside. However, this approach is hindered by the simple fact that it is often unrealistic to remove one's shoes. For example, while people may remove their shoes at their own houses, it is not possible to remove their shoes upon entering a grocery store, a school or the myriad of other public buildings. Indeed, in most if not all high-risk settings, such as hospitals, nursing and rehab facilities, and even doctor's offices, shoe removal is inappropriate, if not outright prohibited.

Given the futility of door mats and shoe removal, most people overlook preventing the invisible contaminants from entering their homes and businesses and instead focus on driving out the contaminants with a plethora of antibacterial cleaning products. This approach presents a monumental task as evidenced by the fact that the household cleaning products market, including floor care products, was a $5 billion market in 2009 with modest increases every year since. Eco-friendly, convenient, antibacterial cleaning products in particular are experiencing growth as awareness increases regarding the dangers associated with the chemicals contained in more traditional cleaning products.

Although not traditionally used outside of industrial environments, shoe cleaning devices are appropriate for a wide variety of settings, such as houses, hospitals, day care centers, schools, office buildings, gyms and hotels. Indeed, shoe cleaning devices do exist on the market. However, historically, shoe cleaning devices have been clunky, awkward and downright ugly to the point a consumer would not purchase one simply because it would be an eyesore in their house. The clunky, awkward appearance is a direct result of the place or environments that shoe cleaning devices have traditionally been used. More often than not, shoe cleaning devices have been used in industrial or outdoor settings. In both settings, there is no need for a shoe cleaning device to blend in with its surroundings, so long as it is effective at cleaning.

Generally, shoe cleaning devices use a combination of agitation surfaces to clean shoe soles. In some instances, these devices also incorporate a wet system in combination with an agitation surface, such as a grate, brush, roller or cleaning fabric to provide a more thorough cleaning system that can target both visible and invisible contaminants. Where wet systems are deployed, they typically involve a fluid dispensing system activated via pressure or a switch and the fluid is usually either water or water mixed with a disinfectant solution.

Depending on the design of the shoe cleaning device, the user may play an active or a passive role in the shoe cleaning operation. Where an active role is required, the user may be required to move their foot back and forth over the agitation surface, while a passive role may allow the user to simply place each foot on or above the shoe cleaning device while fluid is sprayed on the user's shoe.

U.S. Pat. No. 6,668,842 to Wilke discloses an example of an existing shoe cleaning device. The Wilke device is a substantial size, requiring the user to stand on an upper platform during operation. When a force is applied to the platform, a fluid spray comprised of disinfectant and water is dispensed onto the footwear from several angles, coating the entire surface of the user's shoes. However, because the Wilke device is designed for industrial settings, it suffers from several disadvantages in a home or business setting where cleanliness and tidiness is paramount. First, because the fluid dispensing system utilizes a spray head assembly, containing a set of spray nozzles directed at all areas of the shoe, it would be difficult, if not impossible, to confine the liquid to a specific area. This failure to contain the spray makes the device unrealistic for use in a residential or business setting because of the potential for the cleaning liquid, and the resulting contaminated runoff, to spread to areas surrounding the device. Second, the Wilke fluid dispensing system is not limited to the sole of the shoe. In an industrial setting, it is likely that a user would be wearing substantial footwear, such as work boots, or would utilize protective coverings over their footwear. In each instance, the user is not concerned if the entire shoe is contacted with disinfecting spray. In a residential or business setting, however, users will often wear footwear that is sensitive to disinfecting spray. For example, many shoes are made out of delicate material, such as leather or suede, that could not withstand a disinfectant spray. In addition, some shoe styles, leave the tops or even the sides of the foot exposed. For users wearing such shoes, it is critical that the disinfecting spray be directed only at the sole of the shoe so that the spray does not soak the user's feet and socks. Finally, because the Wilke device does not offer a dry section, users are forced to exit the device with wet shoes—an unacceptable situation in most homes and businesses.

Another example of an existing shoe cleaning device is found in U.S. Pat. No. 8,161,590 to Feeg. The Feeg device is formed with a series of rotary brushes used to clean the bottom of a shoe and a series of spring-loaded linear side brushes to clean the sides of the shoe. An elevated tank along the side of the device holds a cleaning or sanitizing fluid that feeds by gravity into the rotary brushes for application to the bottom of the shoe being cleaned. The flow of fluid is activated by pressure on a subframe, which in turn opens a valve. While appropriate for industrial and some business environments, the Feeg device is not appropriate for residential use. Specifically, because the Feeg device does not utilize a cover or top, the rotary brushes are exposed. This design is aesthetically problematic because it is unattractive and functionally problematic because dirt, debris and contaminated cleaning solution will be ejected from the rotary brushes and sprayed onto the surrounding area. Further, like the Wilke device, the Feeg device lacks a dry section, forcing the user to track contaminated cleaning solution onto the floor.

A third example of an existing shoe cleaning device is found in U.S. Patent Application Publication No. US 2012/0066847 to Bai. The Bai device uses rotating cleaning rollers covered in cleaning fabric. Unlike the devices described above, Bai utilizes both wet and dry rollers, with the wet rollers carrying cleaning liquid to clean shoe soles, and adjacent drying rollers provided for drying the shoe soles. However, as with the Feeg device, the Bai device does not have a cover or top, which presents a similar drawback—the rotating cleaning rollers will spray contaminated cleaning solution onto the surrounding area. Further, because Bai utilizes reclaimed cleaning solution, the problem of spraying cleaning solution will become progressively worse as the cleanliness of the cleaning solution deteriorates.

While other devices and methods have been proposed for cleaning the soles of shoes, none of these inventions, taken either singly or in combination, adequately address or resolve the aforementioned problems. Therefore, a need exists for an efficient device and method for cleaning and thoroughly disinfecting the soles of shoes.

SUMMARY OF THE INVENTION

The present invention solves the problems associated with cleaning the soles of shoes and provides a device and method for thoroughly and efficiently cleaning and disinfecting the soles of shoes.

The present invention is directed to a shoe cleaning device comprising a base including a pump bay and a pump located within the pump bay. A top body is disposed above and secured to the base, with the top body including one or more connection port recesses and a fluid cartridge aperture. A cover is configured to mate with the top body and includes a wet area aperture, a fluid port array disposed around the wet area aperture, a dry area aperture, and one or more connection ports configured to mate with the one or more connection port recesses. A fluid cartridge, which contains cleaning solution, is in fluid communication with the pump and the fluid port array such that operation of the pump causes fluid to flow from the fluid cartridge, through the connection ports and out the fluid port array. The shoe cleaning device may also include a pressure sensor positioned within a pressure sensor recess located within the base. In addition, a status indicator recess may be disposed in the upper surface of the top body.

The present invention is also directed to a method for cleaning shoes comprising a first step of providing a shoe cleaning device. The shoe cleaning device comprises a base including a pump bay and a pump located within the pump bay. A top body is disposed above and secured to the base, with the top body including one or more connection port recesses and a fluid cartridge aperture. A cover is configured to mate with the top body and includes a wet area aperture, a fluid port array disposed around the wet area aperture, a dry area aperture, and one or more connection ports configured to mate with the one or more connection port recesses. A fluid cartridge, which contains cleaning solution, is in fluid communication with the pump and the fluid port array such that operation of the pump causes fluid to flow from the fluid cartridge, through the connection ports and out the fluid port array. A second step includes activating the pump by applying pressure to a top surface of the cover. A third step includes moving the sole of the user's shoe across the wet area aperture, coating the shoe sole in cleaning solution. A fourth step includes moving the sole of the user's shoe to the dry area aperture and moving the sole of the user's shoe across the dry area aperture to remove debris and cleaning solution for the shoe sole. A fifth step includes repeating steps two through four for the user's second shoe.

The present invention is also directed to a method for cleaning shoes comprising a first step of providing a shoe cleaning device. The shoe cleaning device comprises a base including a pump bay and a pump located within the pump bay. A top body is disposed above and secured to the base, with the top body including one or more connection port recesses and a fluid cartridge aperture. A cover is configured to mate with the top body and includes a wet area aperture, a fluid port array disposed around the wet area aperture, a dry area aperture, and one or more connection ports configured to mate with the one or more connection port recesses. A fluid cartridge, which contains cleaning solution, is in fluid communication with the pump and the fluid port array such that operation of the pump causes fluid to flow from the fluid cartridge, through the connection ports and out the fluid port array. A second step includes positioning the sole of the user's shoe above the wet area aperture. A third step includes alternately applying and releasing pressure to the top surface of the cover to activate and operate the pump, causing cleaning solution to coat the shoe sole. A fourth step includes adjusting the position of the shoe and repeating steps two and three as required to coat the shoe sole with cleaning solution. A fifth step includes moving the sole of the user's shoe to the dry area aperture and moving the sole of the user's shoe across the dry area aperture to remove debris and cleaning solution for the shoe sole. A sixth step includes repeating steps two through five for the user's second shoe.

BRIEF DESCRIPTION OF THE DRAWINGS

These and other features, aspects and advantages of the present invention will become better understood with reference to the following description, appended claims, and accompanying drawings where:

DETAILED DESCRIPTION OF THE INVENTION

The present device and method are directed to the problem of cleaning and disinfecting the soles of shoe. Specifically, the present invention provides a device and method for thoroughly and efficiently cleaning and disinfecting the soles of shoes.

The present invention addresses the problems related to the cleaning and disinfecting of the soles of shoes. Because users are unlikely to use devices that are either ineffective or too clunky for their homes and businesses, the present invention addresses these needs by providing a device that thoroughly and efficiently cleans and disinfects the soles of shoes in a manner that reduces exposure to the bacteria carried by shoes without detracting from the appearance of the surrounding area.

Figure 1:
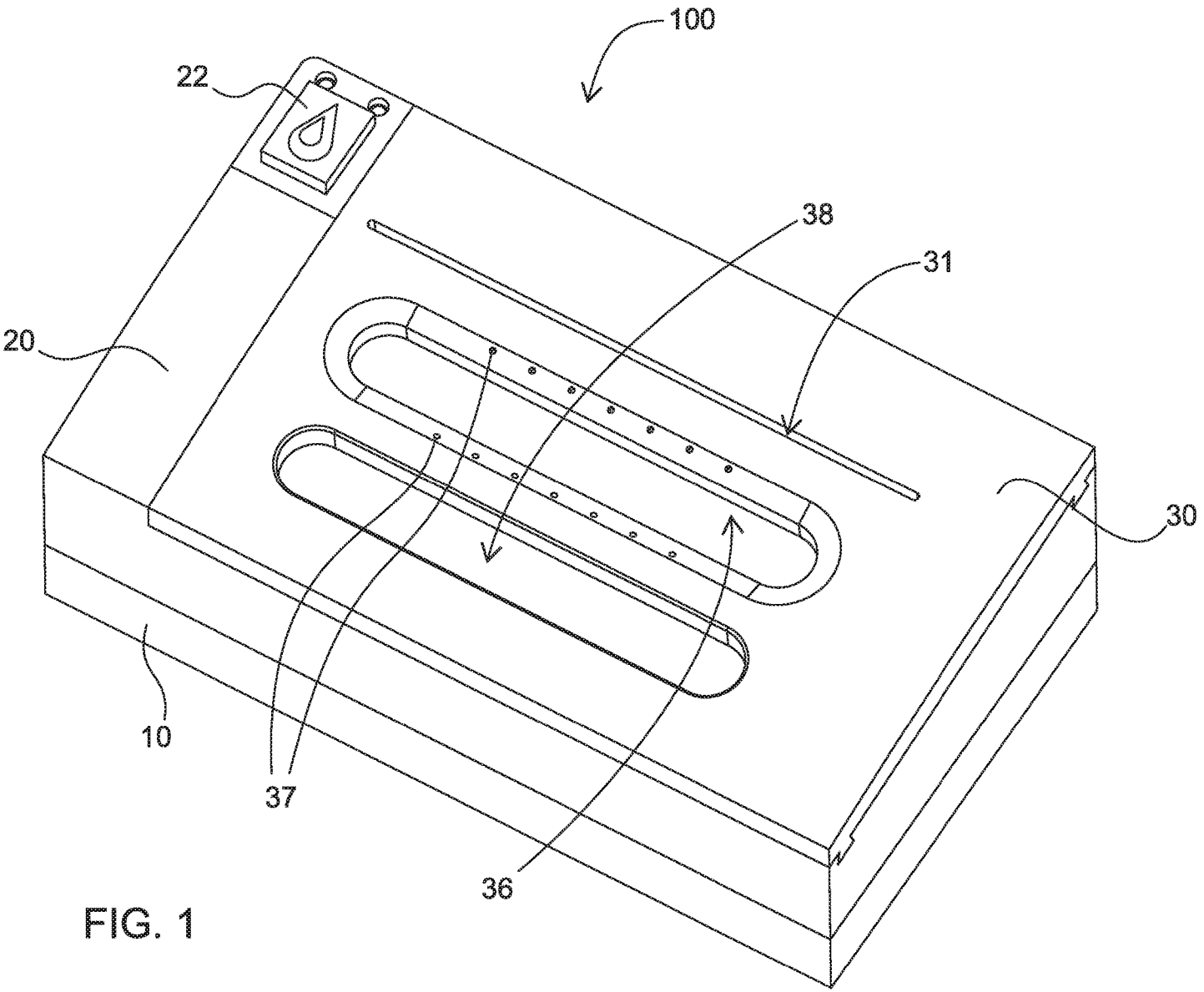
FIG. 1 is a top front perspective view of an embodiment of a shoe cleaning device of the present invention.

Turning to FIG. 1, a shoe cleaning device 100 of the present invention is shown. The shoe cleaning device 100 includes a base 10 and a top body 20. The base 10 and top body 20 are sized and shaped such to facilitate stacking the top body 20 on top of the base 10. In this particular embodiment depicted in FIG. 1, the base 10 and top body 20 are rectangular in shape, but the base 10 and top body 20 may be any shape capable of achieving the necessary functions. The top body 20 may include a cover release switch 22, which when activated, releases the cover 30. When a user activates the cover release switch 22, the cover 30 is released from the top body 20 and may be removed from the shoe cleaning device 100.

Figure 2:
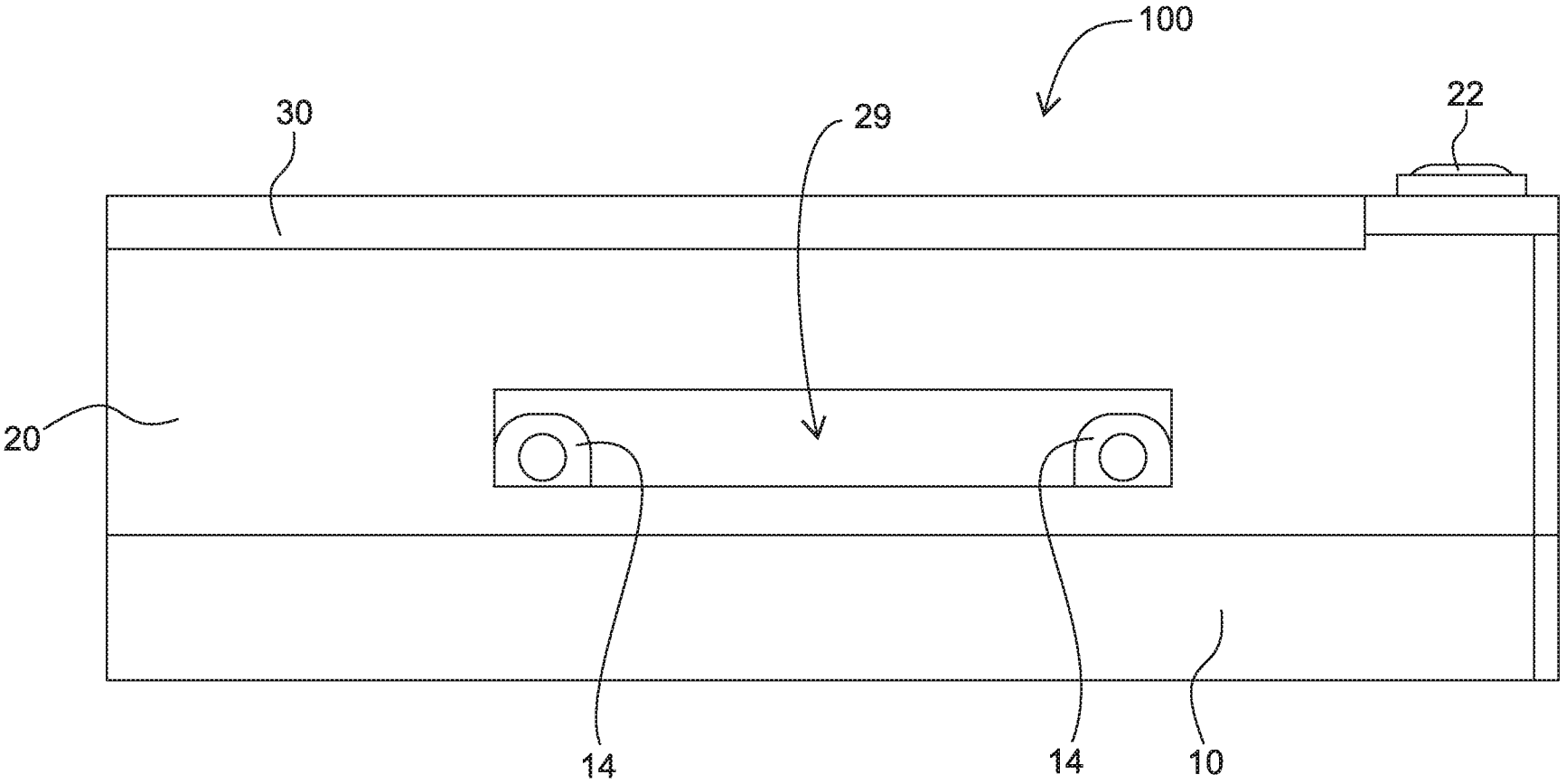
FIG. 2 is a rear perspective view of an embodiment of a shoe cleaning device of the present invention.

As shown in FIG. 2, the top body 20 rests on the base 10. The top body 20 accommodates the mounts 14 protruding from the base 10, which are visible via a fluid cartridge aperture 29. In this embodiment of the shoe cleaning device 100, the fluid cartridge aperture 29 is a rectangular opening in the base 10 where a user can insert a rectangular fluid cartridge. However, one of skill in the art will readily appreciate that the fluid cartridge aperture 29 may be any shape and size capable of housing a fluid cartridge. The primary function of the fluid cartridge aperture 29 is to facilitate replacement of empty fluid cartridges without having to disassemble the shoe cleaning device 100. The fluid cartridge aperture 29 may remain open, as shown in the depicted embodiment, or it may be closed with a cover. The fluid cartridge contains cleaning fluid, which is preferably a mixture of water and disinfecting solution, however, the cleaning fluid may be any cleaning fluid known in the art.

Figure 5:
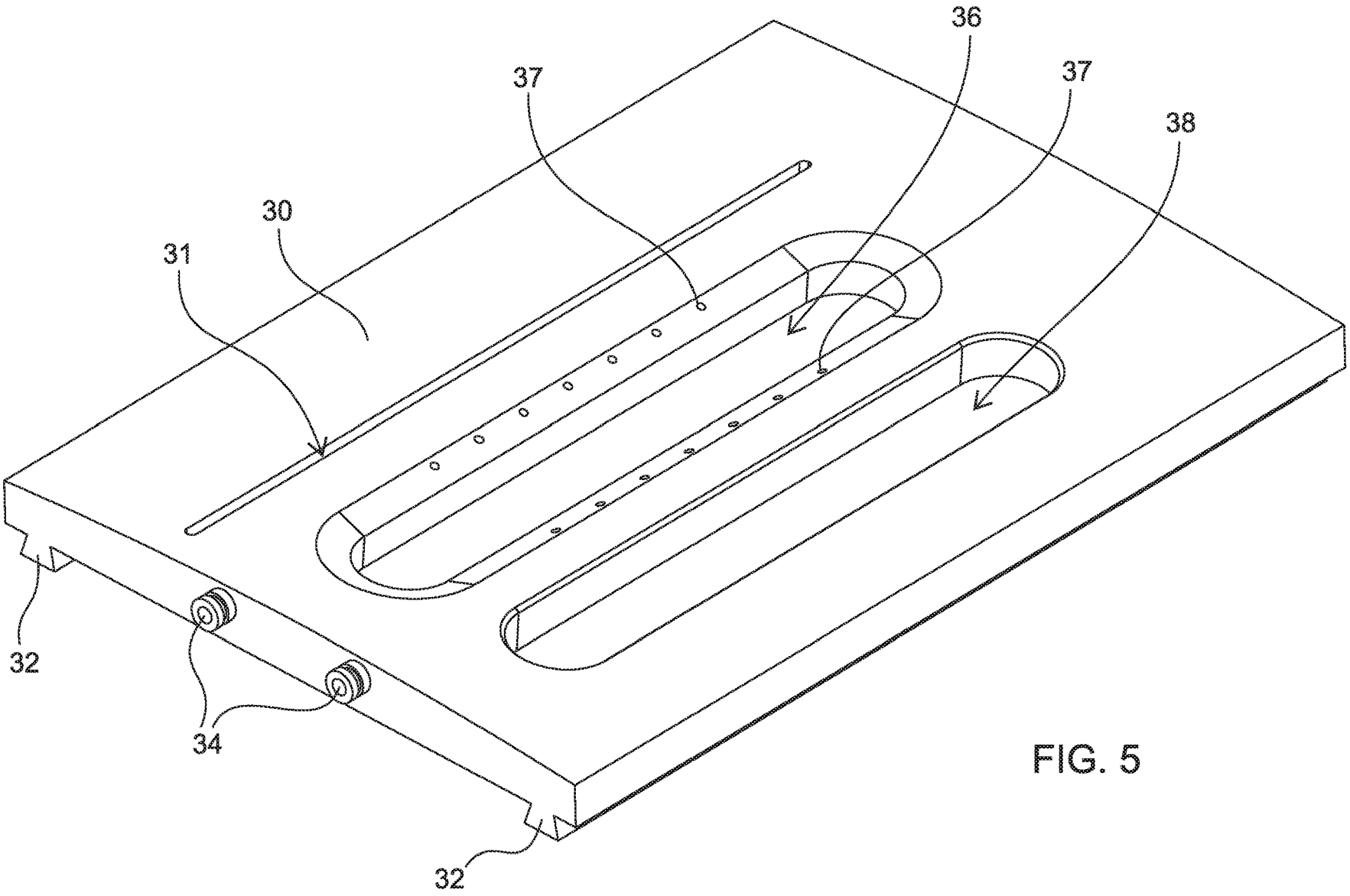
FIG. 5 is a top perspective view of the cover of an embodiment of a shoe cleaning device of the present invention.

Turning to FIG. 5, the cover 30 is depicted removed from the top body 20. The cover is configured to mate with the top body 20. In some embodiments, the cover 30 may feature one or more slides 32, which help mate the cover 30 with the top body 20, and one or more connection ports 34, which act as the connecting means between the cover 30 and the top body 20. In other embodiments, the cover 30 may be connected to the top body 20 via a hinge. Alternatively, the cover 30 may include clips or other fasteners in order to mate the cover 30 with the top body 20.

The connection ports 34 provide fluid connection with a fluid port array 37 located around a wet area aperture 36. During operation, the fluid port array 37 directs cleaning fluid toward the sole of the user's shoe. In the embodiment depicted in FIG. 5, the fluid port array 37 is made up of a series of small holes positioned on both sides of the wet area aperture 36. The interior of the wet area aperture 36 may include an absorbent material that captures the cleaning fluid and further cleans the soles of the shoes. Alternatively, or in addition to utilizing absorbent material to capture the used cleaning fluid, the used cleaning fluid may be routed back into the shoe cleaning device 100 for storage. For example, the cleaning solution cartridge may include a compartment for storing used cleaning solution, allowing the used cleaning solution to be routed back to the cleaning solution cartridge for storage.

A dry area aperture 38 is aligned adjacent to the wet area aperture 36 to allow the user to dry the soles of their shoes after the application of cleaning solution via the fluid port array 37. The dry area aperture 38 includes an absorbent material for drying the soles of the shoes after the cleaning process. This absorbent material may fill the entire dry area aperture 38 or line the dry area aperture 38 without deviating from the scope of the present invention. The absorbent material within the wet area aperture 36 and the dry area aperture 38 is preferably in the form of removable inserts (not shown). These removable inserts may be installed into the wet area aperture 36 and the dry area aperture 38 via tight-fitting friction fit or any other suitable means known by one of skill in the art.

Figure 3:
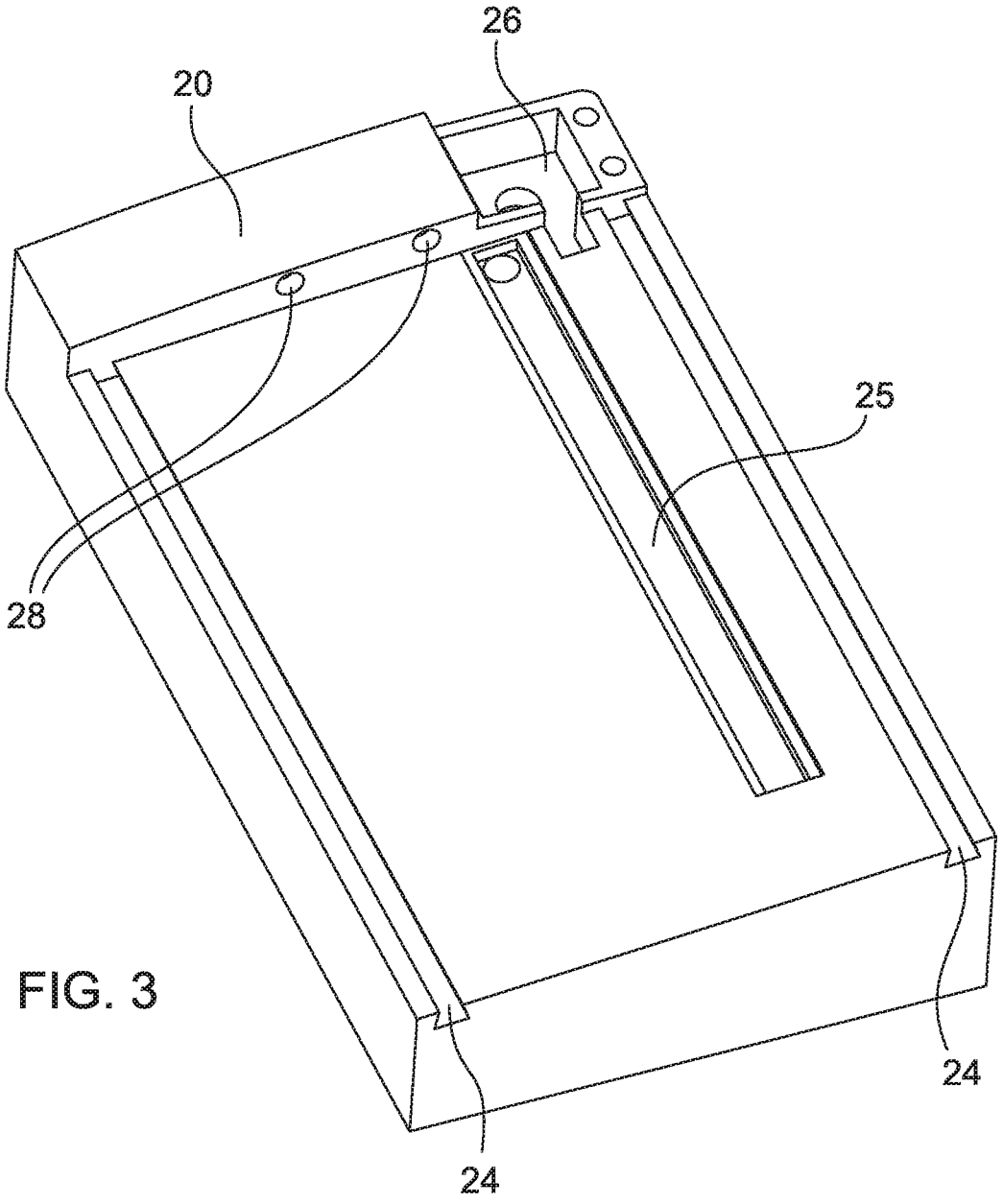
FIG. 3 is a top side perspective view of the top body of an embodiment of the shoe cleaning device of the present invention.

Turning to FIG. 3, the top body 20 of one embodiment of the invention is shown with the cover 30 removed. A series of recesses are disposed within the top body 20. First, one or more slide recesses 24 are provided to facilitate mating the cover 30 with the top body 20. As depicted, the slide recesses 24 may be dovetail slides to permit sliding, while also preventing the cover 30 from lifting away from the top body 20 once in place. The slide recesses 24 may include one or more stops, to prevent the cover 30 from inadvertently moving once the cover 30 is mated with the top body 20. However, in various embodiments of the invention, these stops may be excluded, they may be located on the slides 32, or they may be omitted entirely. In addition, while the slide recesses 24 are depicted as being part of the top body 20 and the slides 32 are depicted as extending from the bottom surface of the cover 30, it will be understood that the orientation of the slides 32 and the slide recesses 24 may be configured so that the slide recesses 24 are present in the cover 30 and the slides extend from the top body 20. Alternatively, the slide recesses 24 and the slides 32 may be omitted entirely in embodiments where the cover 30 is mated to the top body 20 via a hinge or with clips or other fasteners.

In addition to the slide recesses 24, a status indicator recess 25 may also be disposed in the upper surface of the top body 20. Housed within the status indicator recess 25 may be a status indicator (not shown). The status indicator may be a LED or any other visual indicator known in the art. Once the cover 30 is mated with the top body 20, the status indicator recess 25 lies below a status indicator aperture 31 such that the visual indication provided by the status indicator is visible to the user. The status indicator can be used for several purposes. For example, the status indicator can prompt the user to ensure that the user spends the appropriate amount of time utilizing the wet area aperture 36 and dry area aperture 38 sections of the device during the cleaning process, relay the condition of the cleaning fluid, or provide the status of the system battery. However, these options are provided as examples only and the status indicator may be used in any manner known in the art.

The top body 20 further includes one or more connection port recesses 28. The connection port recesses 28 are sized and shaped to mate with the connection ports 34 disposed on the cover 30. When the cover 30 is mated with the top body 20, the connection ports 34 are disposed within the connection port recesses 28. Preferably, the connection ports 34 are mated with the connection port recesses 28 via a tight-fitting friction fit. A person of skill in the art will appreciate that this friction fit may be aided by further features, such as washers or o-rings, to create a seal such that fluid passing through the connection ports 34 will not leak from the connection port recesses 28. In addition it will be understood that the connection ports 34 may be located on the top body 20 with the connection port recesses 28 located on the cover 30 without deviating from the scope of the present invention.

The top body 20 may further includes a cover release switch recess 26. The cover release switch recess 26 is sized and shaped to house the cover release switch 22. As described previously, the cover release switch 22 releases the cover 30 so that it may be removed from the top body 20. The cover release switch 22 is preferably a mechanical switch, but may be any switch known in the art that facilitates the release of the cover 30.

Figure 4:
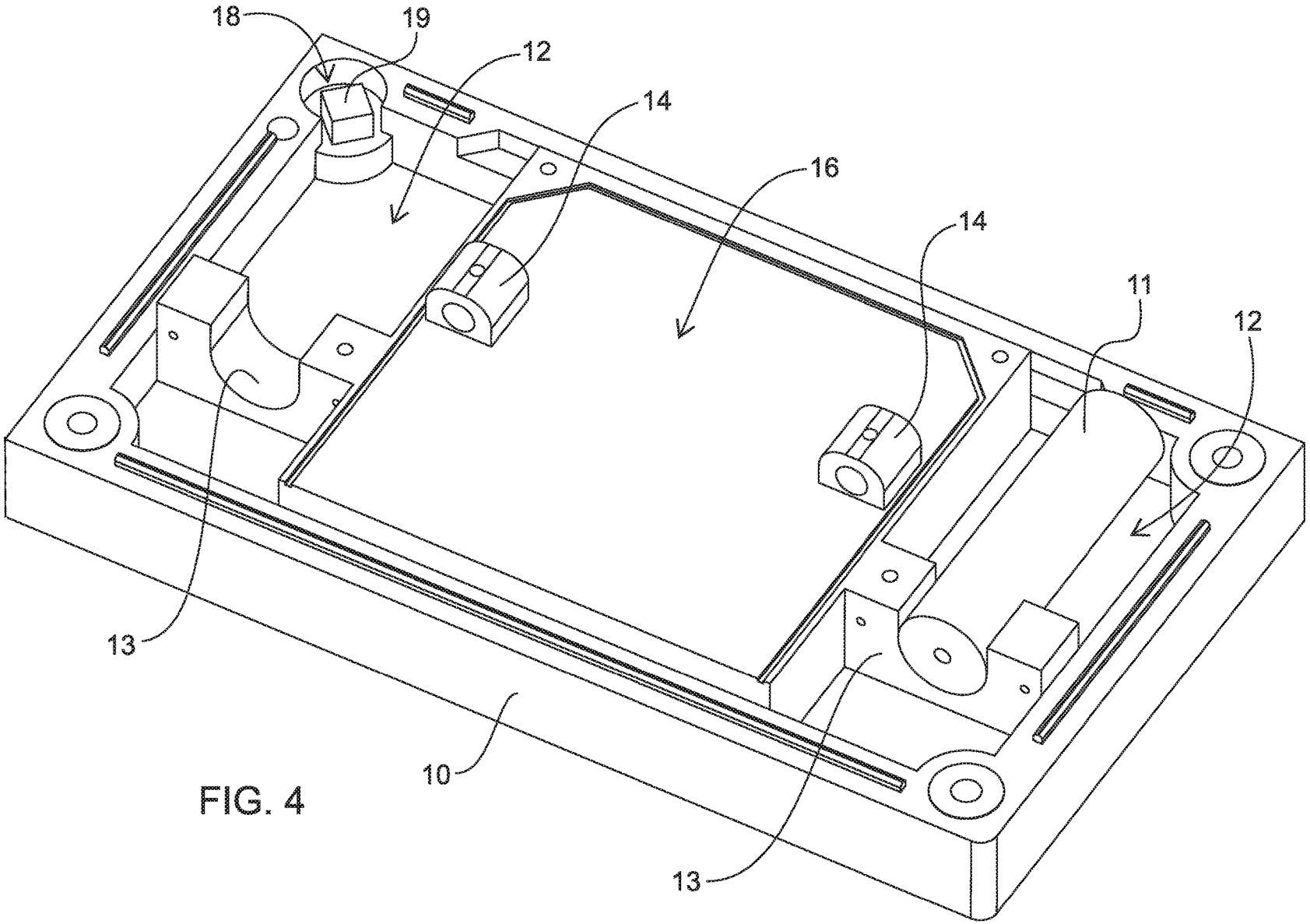
FIG. 4 is a top rear perspective view of the base of an embodiment of a shoe cleaning device of the present invention.

Turning to FIG. 4, the base 10 includes one or more pump bays 12. Within the pump bays 12 are positioned one or more pumps 11, which enable the delivery of cleaning fluid throughout the shoe cleaning device 100. The one or more pumps 11 may be any pump known in the art, but preferably the one or more pumps 11 are peristaltic pumps. The base 10 may further include a pump mount 13 for securing the one or more pumps 11 in place. The base 10 further includes a fluid cartridge platform 16, which serves to support the fluid cartridge. One or more mounts 14 are disposed on the fluid cartridge platform 16. The mounts 14 include a recess, which preferably houses a needle that can puncture the fluid cartridge and provide access to the fluid contained within the fluid cartridge. The needle is placed in fluid connection with the one or more pumps 11 using any known combination of tubing, connectors, fittings and valves. The one or more pumps 11 are further connected to the connection port recesses 28, creating a means for fluid to pass from the fluid cartridge to the connection port recesses 28 under the control of the one or more pumps 11. When the cover 30 is mated with the top body 20, the fluid may pass from the connection port recesses 28 through the connection ports 34 to supply the fluid port array 37. In this way, activation of the one or more pumps 11 will cause cleaning fluid to be sprayed from the fluid port array 37, enabling the application of cleaning fluid to the sole of a user's shoe.

A pressure sensor recess 18 is disposed within the base 10 and preferably houses a pressure sensor 19. The pressure sensor 19 may be any sensor known in the art that will be activated when pressure is applied to the top surface of the cover 30 when the cover 30 is mated with the top body 20. In some embodiments, the pressure sensor 19 controls the operation of the one or more pumps 11 such that the one or more pumps 11 are activated when pressure is applied, and the one or more pumps 11 are deactivated when the pressure is released. However, in other embodiments, activation of the pressure sensor 19 resulting from pressure being applied to the top surface of the shoe cleaning device 100 will prompt the one or more pumps 11 to initiate a pre-programmed cleaning cycle. In instances where a pre-programmed cleaning cycle is initiated, the user can be alerted to the progression of the cycle via visual indicators visible through the status indicator recess 31. In addition to sensing pressure applied to the top surface of the shoe cleaning device 100 generally, the pressure sensor 19 may be connected to a switch located on the top portion of the shoe cleaning device 100, such that when the switch is activated it activates the pressure sensor 19.

The shoe cleaning device 100 may include a power means to power the operation of the device. The power means is preferably a battery or, alternatively, the shoe cleaning device 100 can be wired to utilize household power via a power cord. Where a power means is utilized, the power means can provide power to operate the one or more pumps 11 and the status indicators. In addition to the power means, the shoe cleaning device 100 may include a control board to control the operation of the shoe cleaning device 100. The control board can be programmed to control the cleaning cycles and status indicators described previously, or the control board can simply communicate the activation and deactivation of the pressure sensor 19, thereby controlling the operation of the one or more pumps 11.

Alternatively, instead of using a power means to control the operation of the one or more pumps 11 of the shoe cleaning device 100, the shoe cleaning device 100 may be manually operated. Where the one or more pumps 11 are manually operated pumps, they may be any known type of manually operated pump that can be operated by applying pressure to the upper surface of the shoe cleaning device 100.

When the shoe cleaning device 100 is manually operated, the one or more pumps 11 are activated and operated through the application of pressure. For example, as the user applies force to the top surface of the cover 30, the force is transferred to the one or more pumps 11 such that the force operates the one or more pumps 11 and causes the one or more pumps 11 to cycle fluid through the system. In manually-operated embodiments of the invention the pressure sensor 19 is optional, but may be included in the shoe cleaning device 100 to control visual indicators visible through the status indicator recess 31.

In operation, the shoe cleaning device 100 is fully configured, such that the cover 30 is mated with the top body 20 and the top body 20 is securely fastened to the base 10. A user then simply applies pressure to the top surface of the shoe cleaning device 100, preferably using the sole of the user's shoe to apply the required pressure, which triggers the operation of the one or more pumps 11 and initiates the spray of cleaning fluid from the fluid port array 37. The user simply moves the sole of the shoe across the wet area aperture 36, coating the shoe sole in cleaning solution and, in embodiments where the wet area aperture 36 includes absorbent material, the user can utilize the absorbent material to physically remove contaminants from the sole of the shoe. Once the user has cleaned the shoe sole using the wet area aperture 37, the user moves the shoe to the adjacent dry area aperture 38 to dry the shoe. Absorbent material in the dry area aperture 37 functions to both remove any remaining debris from the shoe sole and also to dry any cleaning solution remaining on the shoe sole. Once the first shoe is clean, the user repeats the process for the second foot. As described above, the user may be guided through the steps of the process by visual indications provided through the status indicator aperture 31.

In embodiments where the shoe cleaning device 100 is manually operated, the user alternately applies and releases pressure, preferably using the sole of their shoe, on the top surface of the cover 30 to activate and operate the one or more pumps 11. Activating the one or more pumps 11 initiates the spray of cleaning fluid from the fluid port array 37. Therefore, as the user simultaneously applies and releases pressure while moving the sole of the shoe across the wet area aperture 36, the shoe sole becomes coated in cleaning solution. Further, in embodiments where the wet area aperture 36 includes absorbent material, the user can utilize the absorbent material to physically remove contaminants from the sole of the shoe. Once the user has cleaned the shoe sole using the wet area aperture 37, the user moves the shoe to the adjacent dry area aperture 38 to dry the shoe. Absorbent material in the dry area aperture 37 functions to both remove any remaining debris and contaminants from the shoe sole and also to dry any cleaning solution remaining on the shoe sole. Once the first shoe is clean, the user repeats the process for the second shoe.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A shoe cleaning device comprising:

a. a base including a pump bay and a pump located within the pump bay;

b. a top body disposed above and secured to the base, the top body including a fluid cartridge aperture;

c. a cover, the cover including a wet area aperture, a fluid port array disposed around the wet area aperture, and a dry area aperture;

d. one or more connection ports configured to mate with one or more connection port recesses, the one or more connection ports and the one or more connection port recesses positioned on the cover and the top body such that the one or more connection ports are located on the cover and the one or more connection port recesses are located on the top body, or such that the one or more connection ports are located on the top body and the one or more connection port recesses are located on the cover;

e. the cover mated with the top body such that the one or more connection ports are disposed within the one or more connection port recesses; and f. a fluid cartridge in fluid communication with the pump and the fluid port array such that operation of the pump causes fluid to flow from the fluid cartridge, through the one or more connection ports and out the fluid port array.

2. The shoe cleaning device of claim 1, further comprising a pressure sensor positioned within a pressure sensor recess located within the base.

3. The shoe cleaning device of claim 1, further comprising a status indicator recess disposed in an upper surface of the top body.

4. The shoe cleaning device of claim 1, wherein the pump is a manually operated pump.

5. The shoe cleaning device of claim 1, wherein the pump is a peristaltic pump.

6. The shoe cleaning device of claim 1, wherein the one or more connection port recesses are located on the cover and the one or more connection ports are located on the top body.

7. A method for cleaning shoes comprising:

a. providing a shoe cleaning device comprising:

i. a base including a pump bay and a pump located within the pump bay;

ii. a top body disposed above and secured to the base, the top body including a fluid cartridge aperture;

iii. a cover, the cover including a wet area aperture, a fluid port array disposed around the wet area aperture, and a dry area aperture;

iv. one or more connection ports configured to mate with one or more connection port recesses, the one or more connection ports and the one or more connection port recesses positioned on the cover and the top body such that the one or more connection ports are located on the cover and the one or more connection port recesses are located on the top body, or such that the one or more connection ports are located on the top body and the one or more connection port recesses are located on the cover;

v. the cover mated with the top body such that the one or more connection ports are disposed within the one or more connection port recesses; and vi. a fluid cartridge in fluid communication with the pump and the fluid port array such that operation of the pump causes fluid to flow from the fluid cartridge, through the one or more connection ports and out the fluid port array;

b. activating the pump by applying pressure to a top surface of the cover;

c. moving the sole of a users shoe across the wet area aperture, coating the shoe sole in cleaning solution;

d. moving the sole of the users shoe to the dry area aperture and moving the sole of the users shoe across the dry area aperture to remove debris and cleaning solution from the shoe sole; and e. repeating steps b, c and d fora users second shoe.

8. The method of claim 7, further comprising a pressure sensor positioned within a pressure sensor recess located within the base.

9. The method of claim 7, further comprising a status indicator recess disposed in an upper surface of the top body.

10. The method of claim 7, wherein the pump is a peristaltic pump.

11. The method for cleaning shoes of claim 7, wherein the one or more connection port recesses are located on the cover and the one or more connection ports are located on the top body.

12. A method for cleaning shoes comprising: a. providing a shoe cleaning device comprising:

i. a base including a pump bay and a pump located within the pump bay;

ii. a top body disposed above and secured to the base, the top body including a fluid cartridge aperture;

iii. a cover, the cover including a wet area aperture, a fluid port array disposed around the wet area aperture, and a dry area aperture;

iv. one or more connection ports configured to mate with one or more connection port recesses, the one or more connection ports and the one or more connection port recesses positioned on the cover and the top body such that the one or more connection ports are located on the cover and the one or more connection port recesses are located on the top body or such that the one or more connection ports are located on the top body and the one or more connection port recesses are located on the cover;

v. the cover mated with the top body such that the one or more connection ports are disposed within the one or more connection port recesses; and vi. a fluid cartridge in fluid communication with the pump and the fluid port array such that operation of the pump causes fluid to flow from the fluid cartridge, through the one or more connection ports and out the fluid port array;

b. positioning the sole of the user's shoe above the wet area aperture;

c. alternately applying and releasing pressure to a top surface of the cover to activate and operate the pump, causing cleaning solution to coat the shoe sole;

d. adjusting the position of the shoe and repeating steps b and c as required to coat the shoe sole with cleaning solution;

e. moving the sole of the users shoe to the dry area aperture and moving the sole of the user's shoe across the dry area aperture to remove debris and cleaning solution from the shoe sole; and f. repeating steps b through e for a user's second shoe.

13. The method of claim 12, further comprising a pressure sensor positioned within a pressure sensor recess located within the base.

14. The method of claim 12, further comprising a status indicator recess disposed in an upper surface of the top body.

15. The method of claim 12, wherein the pump is a manually operated pump.

16. The method of claim 12, wherein the pump is a peristaltic pump.

17. The method for cleaning shoes of claim 12, w herein the one or more connection port recesses are located on the cover and the one or more connection ports are located on the top body.

* * * * *